United States Patent [19]

Perfetti

[11] Patent Number: 4,834,577

[45] Date of Patent: May 30, 1989

[54] PROCESS AND MEANS FOR THE PROTECTION OF ROADWAY DRESSINGS AGAINST CRACK INITIATION

[75] Inventor: Jacques Perfetti, Le Vesinet, France

[73] Assignee: Rhone-Poulenc Fibres, Lyons, France

[21] Appl. No.: 947,360

[22] Filed: Dec. 29, 1986

[30] Foreign Application Priority Data

Dec. 26, 1985 [FR] France ..... 85 19371

[51] Int. Cl.[4] ..... B32B 3/26

[52] U.S. Cl. ..... 404/82; 404/134; 156/71; 428/291; 428/489

[58] Field of Search ..... 156/71, 181; 404/66, 404/67, 72, 82, 134; 428/289, 291, 489; 65/2

[56] References Cited

U.S. PATENT DOCUMENTS

| | | | |
|---|---|---|---|
| 2,619,705 | 12/1952 | Foster | 152/563 X |
| 3,189,510 | 6/1965 | Eldred | 428/107 X |
| 3,557,671 | 1/1971 | Vasiloff | 404/82 |
| 3,670,506 | 6/1972 | Gaudard | 404/17 X |
| 4,420,524 | 12/1983 | Gorgati | 428/489 X |
| 4,472,086 | 9/1984 | Leach | 404/70 X |
| 4,508,770 | 4/1985 | Muncaster et al. | 404/75 X |
| 4,622,054 | 11/1982 | Huey et al. | 65/2 |
| 4,637,946 | 1/1987 | Shah et al. | 404/134 X |
| 4,678,703 | 7/1987 | Shibasaki et al. | 156/308.2 X |

FOREIGN PATENT DOCUMENTS 2017264 5/1970 France .

OTHER PUBLICATIONS

Colombier, et al, Second International Conference on Geotextiles, Las Vegas, Nevada, "Using a Geotextile to Prevent Shrinkage Cracks of Rigid Pavement", (1982).

Colombier, et al., Third International Conference on Geotextiles in Vienna, Austria, "Reflective Cracking: A New Test for SAMI" (1986).

*Primary Examiner*—Michael A. Ball
*Assistant Examiner*—Jeff H. Aftergut
*Attorney, Agent, or Firm*—Sherman and Shalloway

[57] ABSTRACT

The protection of roadway surface dressings against the initiation and the propagation of cracks is accomplished by interposition between the base layer and the surfacing layer of a binding layer consisting of a nonwoven geotextile interface impregnated with modified bituminous binders. The textile interface is a nonwoven fabric composed of continuous synthetic filaments of flat cross-section (width-to-thickness ratio of between 10/1 and 5/1), and are resistant to the temperatures of application of bitumen or of bituminous materials, have a low void index, are resistant to aromatic and aliphatic solvents, have a low compressibility, are deformable in the plane of laying and have a surface density preferably of between 100 grams and 300 grams per square meter. The modified bitumen is preferably based on styrene/-butadiene/styrene copolymer and has characteristics such as: penetration 180/220, ring and ball 74° C., penetration index 1.7, and is used in a quantity of between 300 grams and 800 grams per square meter.

10 Claims, 1 Drawing Sheet

PROCESS AND MEANS FOR THE PROTECTION OF ROADWAY DRESSINGS AGAINST CRACK INITIATION

The present application relates to an improvement in the process and a means for the protection of roadway surface dressings against the initiation and the propagation of cracks.

Roadways, whether rigid or semirigid, generally consist of several layers: the bituminous or concrete upper or surfacing layer, and lower layers known as base and foundation layers, which consist of materials treated with hydraulic binders such as cement, blast-furnace slag, fly ash or pozzuolana.

These hydraulic binders endow the materials with advantageous properties (high stiffness modulus) and, furthermore, their use is economically advantageous.

However, the use of these binders presents a disadvantage; namely, these materials crack under the action of two types of shrinkage: setting shrinkage and thermal shrinkage.

Cracks formed in the base layer are transmitted to the surfacing layer which itself cracks, allowing water and possibly other contaminating products to enter the body of the roadway, thus causing rapid and considerable deterioration. It is necessary, therefore, to find a means for preventing and/or for at least delaying the initiation and the transmission of the cracks to the surfacing layer.

In general, the cracking is produced chiefly by the stresses of a static or dynamic (traffic) nature, to which the roadways are subjected. The tensile and compressive forces due to the movements of the base layer which is treated with hydraulic binders (setting shrinkage and thermal shrinkage) cause, as already indicated, initiation of the cracking of the layers, starting at their bottom, further accentuated by the stresses produced by flexing under the passage of vehicles which give rise to tensile forces at the base of the surfacing layer and vibrations at right angles to the cracks in the case where the structure is undersized. Stresses of a thermal origin similarly cause the initiation of cracking in the surfacing layer, and as soon as the initiation has taken place, the stresses generated by the traffic increase due to concentration at the bottom of the crack, thus causing this crack to propagate upwards; thus, all these stresses jointly lead to the rapid rise of the cracks in the surfacing layer and then to their appearance at the surface.

Means which enable the cracks to be avoided or delayed have already been tested; thus, in the United States, tests have been carried out since about fiteen years ago, using, for example at the interface, rubber bitumen membranes which are cast in situ, which decouple the movements from the cracked support, and polyester grids with high mechanical properties to improve the tensile strength of the bituminous concrete surface layers, but the results obtained were not satisfactory, since a more or less rapid appearance of surface cracks demonstrated the low reliability of the tested systems with the passage of time. To reinforce bituminous concrete layers in order to prevent their cracking, attempts have also been made to use needled polypropylene non-wovens combined with bituminous binders in various forms (emulsion, and the like) and deposited on the bitumen layer; taking the properties of polypropylene into account, bituminous binders must still be employed at a temperature of less than 150° C., with the use of cut-backs (solvent-diluted bitumen).

Trials have also been carried out, about ten years ago, of a polyester nonwoven deposited on a cracked concrete roadway (shrinage crack and fatigue crack) covered with a 15-centimeter layer of bituminous concrete. It was found, however, that the impregnation produced was non-uniform and that poorly impregnated regions caused the layers to come apart.

However, while it was noted that, in general, a nonwoven textile interface gave encouraging results, the existing problem, namely how to avoid the rising of the cracks to the surface and the delay in the initiation of the said cracking in the roadway dressings, both on high-ways and at airports, remained without any satisfactory permanent solution, because an excessive parting of the layers gave rise to a danger of separation and hence, on the one hand, the formation of potholes or other phenomena detrimental to the user's safety and comfort and, on the other hand, led to the need for costly maintenance. The required interface must, at the same time react in a rigid manner to the dynamic (traffic) stresses and must deform in a plastic manner under slow stresses (thermal shrinkage movements).

The present application proposes a process and a means, both of which are simple and economical, for delaying the initiation of cracking and its propagation in the surfacing layer of roadways.

Figure 1:
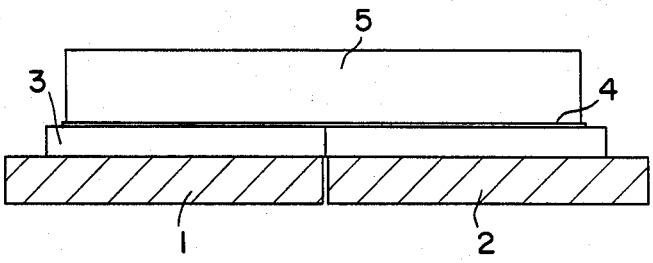
FIG. 1 is a schematic side elevation view of two supporting metal plates used in a test device for applying a shear test to the geotextile interface, shown supporting a standard road material including the textile interface.

The subject of the present invention is an improvement in the process and means for the protection of surface dressings of roadways, using a nonwoven geotextile interface, against the rise of the cracking from the lower layers, known as base layers, which process and means are characterized in that, between the base layer and the surfacing layer, a binding layer consisting of a nonwoven geotextile interface impregnated with modified bituminous binders is interposed, in which the textile interface is a nonwoven of continuous synthetic filaments of flat cross-section, resistant to the application temperatures of bitumen or of bituminous materials, preferably above 170° C., with a low void index, resistant to aromatic and aliphatic solvents, having a low compressibility, deformable in the plane of laying and with a surface density which is preferably between 100 grams and 300 grams per square meter, and the modified bitumen preferably exhibits characteristics such as: penetration: 180/220, ring and ball: 74° C., penetration index: 1.7; it is used in a quantity of between 300 grams and 800 grams per square meter.

The present application also relates to a nonwoven geotextile interface impregnated with a bituminous binder, characterized in that it consists:

of a nonwoven textile interface of continuous synthetic filaments of flat cross-section, resistant to the temperatures of application of bitumen or of bituminous materials, preferably above 170° C., with a low void index, resistant to aromatic and aliphatic solvents, having a low compressibility, deformable in the plane of laying and with a surface density preferably between 100 grams and 300 grams per square meter, and of a modified bituminous binder preferably exhibiting characteristics such as: penetration 180/220, ring and ball 74° C., penetration index 1.7, used in a quantity of between 300 grams and 800 grams per square meter.

As a nonwoven geotextile of synthetic continuous filaments, there are preferably used nonwovens made of continuous filaments based on a polyester such as polyethylene terephthalate, which are resistant to the usual temperatures of bitumen application which are above 170° C., the filaments being flat-sectioned, with a width-to-thickness ratio preferably of between 10/1 and 5/1.

As modified bitumen, there is preferably used a bitumen based on styrene/butadiene/styrene copolymer which has good characteristics, which are compatible with the proposed solution.

The continuous filaments are flat in cross-sections; it has been found, in fact, that the use of filaments of round cross-sections, as generally employed in geotextile applications, presents the disadvantage, in the case of the nonwoven, of being highly compressible and, when the nonwoven is impregnated with bitumen, an exudation is observed under the passage of trucks and other heavy vehicles, for example the machines for laying the bituminous concrete surfacing, the required quantity of bitumen being large (from 800 g/m$^2$ to 1,200 g/m$^2$); having a certain thickness and consequently being highly compressible, the nonwoven geotextile whose filaments are round in cross-section behaves as a kind of sponge when it is impregnated with bitumen.

The geotextile consisting of a nonwoven of continuous filaments is produced according to known processes such as that described in the applicant's French Pat. No. 1,601,049, by using a die whose orifices enable flat-sectioned filaments to be produced. The sheet may be needled, graded, calendered or treated by any other binding means compatible with its use; given the flat cross-section of the yarns, the sheet will preferably be calendered by means of a textured calender permitting pointwise calendering; the binding of the flat-sectioned yarns by calendering points enables the nonwoven to be deformable in its plane of laying, and its deformation, on an internal scale, takes place in a manner similar to that of scales permitting the continuity of the imperviousness of the textile/bitumen composite; at the same time this provides a nonwoven which is impervious, of low compressibility, and of low rigidity in the plane corresponding to the required characteristics.

The characteristics of the modified bitumen are measured as follows:

- penetrability: depth of indentation, expressed in tenths of a millimeter of a standardized needle, under a load of 100 grams which is applied for 5 seconds at 25° C.,
- ring and ball: this is a temperature denoting the softening point of the bitumen, measured as follows: a steel ball is placed on a disc of bitumen cast in a ring. The whole is placed in a water bath and heated at constant rate. Under the effect of the weight of the ball and of the temperature, the bitumen flows and when the pocket produced in this manner touches the bottom plate of the apparatus, the temperature reached, which thus characterizes the softening point, is noted.

Figure 2:
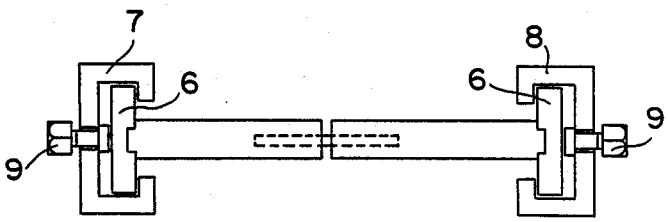
FIG. 2 is a schematic view of the test device for testing the geotextile interface including the jaws for holding the supporting metal plates shown in FIG. 1.

The anticracking interface should: maintain the bonding between the surfacing layer and the support under the action of the traffic; permit a decoupling of the surfacing layer in respect of the thermal shrinkage movements of the support, by elastic shear or by interface flow; the flow always presenting the danger of an instability of the surfacing layer under its own weight (gradient, others); and ensures the retention of the imperviousness of the surface after a possible rise of the crack through the bituminous mix. A test device enabling the anticracking structures to be tested has been developed by the Central Laboratory of the French Ministry of Public Works. This device, which permits a shear test to be performed, is shown diagrammatically in FIG. 1; its operating principle may be described as follows: two supporting metal plates 1 and 2 may be moved apart at a stipulated speed; they simulate the treated cracked foundation subjected to a thermal shrinkage. On these metal plates there is arranged a small thickness of a standard material 3 which will be precracked, followed by the interface 4 to be tested in shear, and lastly a surfacing layer 5, also standardized. The choice of a sulphur-containing cast material (cast bituminous concrete containing sulphur or CBCS) for the support 3 and the surfacing layer 5 makes it possible, on the one hand, to dispense with damping and, on the other hand, to ensure better reproducibility of the tests. As shown in FIG. 2, each of the two metal plates 1 and 2 ends in a jaw 6; these are clamped between the jaws 7 and 8 of the test device, one of the jaws 7 being stationary and the other 8 movable, driven by an electric motor. The motor can turn in either direction, enabling the two half-supports to be moved apart or closer. Screws 9 on the back of each jaw enable the claws to be clamped so as to reduce play to a minimum. The whole is placed in a constant-environment cabinet, the temperature of which may be selected. The material thicknesses used are: support layer: CBCS 0/6–1.5 cm; tensile-layer: CBCS (0/10–4 cm, the first digit denoting the particle size of the support in mm, the second the thickness in centimeters. The measurements are carried out under the following conditions:

(a) tests at low speed and low temperature (5° C.) to test the possibilitites of decoupling of the anticracking layer during thermal shrinkage, tests at high speed at a temperature of 20° C. enabling the quality of the bond between the support layer and the control layer to be assessed under stresses due to the passage of a rolling load. The specimen to be tested is installed in the structure, whose lower, precracked support-layer part represents the sand/gravel mixture treated with hydraulic binders. The material is first placed in position by opening the crack by a predetermined quantity. Alternating tensile and compressive stresses are then applied around this point.

These test cycles are carried out in succession at 20° C. and at a speed of 30 mm/h and at 5° C. at a speed of 3 mm/h. The force applied and the distortion of the structure to be tested are measured in each case. The following conventional terminology is used for each cycle: the force amplitude: the sum of the maximum forces in each direction (traction/compression); amplitude of opening: the sum of the displacements, measured in each direction for the same single cycle; and pseudo-rigidity of the interface G=amplitude of the force/amplitude of opening. For each test, there is a value of G at 5° C., or G 5 and a value of G at 20° C., or G 20. The interface which is the most suitable for the solution to the problem which is posed must have a high value of G 20 corresponding to the lowest possible value of G 5; an interface of this kind ensures good binding, and hence good bonding between the layers under the action of the traffic and it partly decouples the two layers CBCS 0/6–1.5 cm and CBCS 0/10–4 cm, when they are subjected to the stresses induced by thermal changes.

Figure 3:
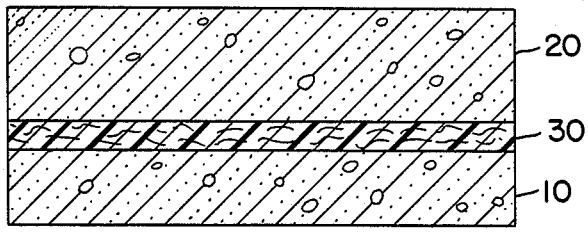
FIG. 3 is a cross-sectional view of a roadway including a layer of impregnated nonwoven geotextile interface according to the invention.

FIG. 3 illustrates a cross-section of a layer of the impregnated nonwoven geotextile interface 30 interposed between a roadway base layer 10 and surface layer 20.

The following example illustrates the present application without limiting it.

EXAMPLE

The interface geotextile support used is two nonwovens of multifilamentary continuous filaments produced under the same extrusion conditions, made of polyethylene terephthalate, one A being of conventional type, 200 g/m$^2$, the filaments having a unit linear density of 8 dtex/fibre, of round cross-section, needled (Bidium U 24, produced by Rhone-Poulenic Fibres), the other B also weighing 200 g/m$^2$, flat, 13 dtex/fibre yarns, width/thickness ratio 7/1, calendered using point-form binding (studded calendering width 1 point every 5 mm).

For each of these two geotextiles, produced by Rhone-Poulenc Fibres, the binder concentration was varied around a mean value known as the impregnation binder content. This binder content corresponds to the percentage of void in the geotextile under a pressure 0.2 MPa (a value close to the pressure due to the weight of the surfacing layer). However, for practical reasons, the binder content was limited to 1,200 g/m$^2$ for A (because of exudation) and to a minimum of 600 g/m$^2$ for B, below which content it is difficult to guarantee a uniform rate of application in the material; furthermore, because of the flat filament cross-section, the nonwoven B being of low compressibility, at least 300 g off bitumen/m$^2$ must be left free to provide the bonding action. The bitumen used was a pure 80/100 bitumen and an elastomeric styrene/butadiene/styrene bitumen of the Cariphalte type (Shell). The two specimens were subjected to tests by means of the device described above; a pure 80/100 bitumen without geotextile was also used as control.

The results of these tests are listed in the two tables I and II below.

TABLEAU 1

| | | NONWOVEN A | | | | | |
|---|---|---|---|---|---|---|---|
| | | 20° C. | | | 5° C. | | |
| BINDER | APPLICATION RATE | Force amplitude daN | Opening amplitude mm | G. $10^{-6}$ N/m | Force amplitude daN | Opening amplitude mm | G. $10^{-6}$ N/m |
| 80/100 BITUMEN | 816 g/m$^2$ | 177 | 0.518 | 3.4 | 480 | 0.468 | 10.3 |
| | 1430 g/m$^2$ | 114 | 0.520 | 2.2 | 396 | 0.444 | 38.9 |
| | 2040 g/m$^2$ | 134 | 0.538 | 2.5 | 430 | 0.472 | 9.2 |
| | 2650 g/m$^2$ | 112 | 0.527 | 2.1 | 350 | 0.490 | 7.1 |
| 180/220 SPECIAL BITUMEN | 1000 g/m$^2$ | 40 | 0.552 | 0.73 | 98 | 0.542 | 1.8 |
| Control without geotextile Pure bitumen bonding | 400 g/m$^2$ | 248 | 0.426 | 6.0 | 705 | 0.280 | 28 |

TABLEAU 2

| | | NONWOVEN B | | | | | |
|---|---|---|---|---|---|---|---|
| | | 20° C. | | | 5° C. | | |
| BINDER | APPLICATION RATE | Force amplitude daN | Opening amplitude mm | G. $10^{-6}$ N/m | Force amplitude daN | Opening amplitude mm | G. $10^{-6}$ N/m |
| 80/100 BITUMEN | 235 g/m$^2$ | 111 | 0.518 | 2.15 | 408 | 0.440 | 9.3 |
| | 337 g/m$^2$ | 144 | 0.506 | 2.8 | 467 | 0.423 | 11 |
| | 378 g/m$^2$ | 161 | 0.510 | 3.2 | 529 | 0.412 | 12.8 |
| | 637 g/m$^2$ | 141 | 0.506 | 2.8 | 518 | 0.416 | 12.4 |
| SPECIAL BITUMEN | 637 g/m$^2$ | 136 | 0.526 | 2.6 | 243 | 0.512 | 4.7 |
| Control without geotextile Pure bitumen bonding | 400 g/m$^2$ | 248 | 0.426 | 6.0 | 705 | 0.28 | 28 |

Insofar as the nonwoven A is concerned, in which the filaments are round in cross-section, with the pure bitumen 80/100, the results are very different from those obtained for the control without interposition of geotextile. This result confirms, therefore, that the process has an influence on the transmission of the cracks.

Within the very wide range of the concentrations of impregnation binder which were investigated, the effect of this parameter is quite weak, every change in the pseudo-rigidity at 5° C. being also observed in the pseudo-rigidity at 20° C.

Work-site experiments have made it possible to demonstrate that it was difficult to depart from a binder concentration range of between 800 g/m$^2$ and 1,200 g/m$^2$; it may be seen, therefore, that the nonwoven A, 1,000 g/m$^2$ of 80/100 bitumen, results in:

a pseudo-rigidity of 2 to 3 $10^{-6}$ N/m at 20° C., and a pseudo-rigidity of 9 to 12 $10^{-6}$ N/m at 5° C.

The use of an elastomeric bitumen at an application rate of 1,000 g/m$^2$ reduces G 5° very markedly, which is a favourable feature, but it also greatly reduces G 20°. Under these conditions it may be considered that the conditions of bonding between the layers are inadequate to avoid an accelerated fatigue of the surfacing layer under the effect of the traffic and to prevent the cracks from rising.

Insofar as the nonwoven B is concerned, in which the filaments are flat in cross-section, it is found, as for the nonwoven A, that the results obtained, whatever the application rate of 80/100 bitumen, are very different from those found for the control without any geotextile, and this also confirms in this case the positive part played by the geotextile.

Within the investigated range of rates of application of pure bitumen, the pairs of pseudo-rigidities at 5° C. and 20° C. which are obtained are fairly close to those found the nonwoven A.

For a bitumen content of approximately 600 g/m$^2$, which is known to be technically feasible and sufficient to ensure the bonding, the values obtained are:

a pseudo-rigidity of 3 $10^{-6}$ N/m at 20° C., and a pseudo-rigidity of 12 $10^{-6}$ N/m at 5° C.

In contrast, the nonwoven complex B, with an elastomeric binder, produces a markedly different result which is of interest for the objective in mind. In fact, with 637 g/m$^2$ of elastomeric bitumen, a pseudo-rigidity of 2.6 $10^{-6}$ N/m is obtained at 20° C., that is to say close to that obtained for the same application rate of pure bitumen; in contrast, G 5° is divided by 3 (4.6 $10^{-6}$ N/m instead of 12.4 $10^{-6}$ N/m).

It is found, in fact, that the use of a nonwoven with filaments of flat cross-section combined with a modified bitumen gives superior results; furthermore, from an economic standpoint, the quantity of bituminous binder which is employed is considerably smaller than that used with a conventional, compressible nonwoven with filaments of round cross-section.

The example clearly demonstrates the effectiveness of the complex proposed in the present application with regard to the slowing down which it permits in the rise of the cracks.

What is claimed is:

1. A process for delaying initiation of crack formation and slowing propagation thereof in a roadway having a base layer and a surface layer, said roadway being capable of supporting and carrying vehicle traffic, said vehicle traffic causing stresses on said roadway, which stresses can cause initiation of crack formation in said base layer and propagation of cracks formed in said base layer from said base layer to said surface layer, said process comprising interposing a binding layer between the base layer and the surface layer, said binding layer comprising a nonwoven geotextile interface impregnated with from about 300 to about 800 grams, per square meter of geotextile interface, of a modified bituminous binder, said geotextile interface being a nonwoven textile formed of continuous synthetic filaments of flat cross-section and being capable of withstanding temperatures at which said binder is applied thereto, and being further characterized by a low void index, resistance to aromatic and aliphatic solvents, and low compressibility, said nonwoven textile being deformable in its plane of laying;

said geotextile interface effectively bonding the base layer and surface layer even under the stresses of vehicle traffic on said roadway, while simultaneously permitting decoupling of the surface layer, in response to thermal shrinkage movements of said base layer, through elastic shear or interface flow, whereby the initiation of crack formation and the rate of propagation of cracks formed in said base layer to said surface layer are effectively reduced.

2. The process of claim 1 wherein the nonwoven geotextile is formed of polyester based continuous filaments, of flat cross-section, with a width-to-thickness ratio of from 10/1 to 5/1.

3. The process of claim 1 wherein the modified bituminous binder comprises a styrene/butadiene/styrene copolymer.

4. The process of claim 1 wherein the nonwoven geotextile has a surface density of from about 100 to about 300 grams per square meter.

5. The process of claim 1 wherein the modified bitumen has a penetration of 180/220, a ring-and-ball temperature of 74° C., and a penetration index of 1.7.

6. A nonwoven textile interface reinforcement material for protecting roadway surface dressings of a roadway having a lower base layer and a surface layer, and intended to support and carry thereon vehicle traffic, from surface cracking, said interface being formed by impregnating a nonwoven geotextile interface with from about 300 to about 800 grams, per square meter of geotextile interface, of a modified bituminous binder, said geotextile interface being a nonwoven textile capable of withstanding temperatures of at least about 170° C., and being further characterized by a low void index, resistance to aromatic and aliphatic solvents, low compressibility, and deformability in its plane of laying in roadway surfaces, said nonwoven textile being formed of continuous synthetic filaments of flat cross-section, whereby when said geotextile interface is interposed between the lower base layer of a roadway and the surface layer of the roadway, the base layer and surface layer are effectively bonded even under stresses of vehicle traffic on the roadway, while simultaneously decoupling of the surface layer, in response to thermal shrinkage movements of the base layer is permitted, thereby effectively reducing the rate of propagation of cracks formed in the base layer to the surface layer.

7. The textile interface of claim 6 wherein the nonwoven geotextile is formed of polyester based continuous filaments, of flat cross-section, with a width-to-thickness ratio of from 10/1 to 5/1.

8. The textile interface of claim 6 wherein the modified bituminous binder comprises a styrene/butadiene/styrene copolymer.

9. The textile interface of claim 6 wherein the nonwoven geotextile has a surface density of from about 100 to about 300 grams per square meter.

10. The textile interface of claim 6 wherein the modified bitumen has a penetration of 180/220, a ring-and-ball temperature of 74° C., and a penetration index of 1.7.

* * * * *